US006279818B1

(12) United States Patent
Kim et al.

(10) Patent No.: US 6,279,818 B1
(45) Date of Patent: Aug. 28, 2001

(54) MULTIPURPOSE ADJUSTABLE SINGLE SHEET CONTAINER

(76) Inventors: Richard H. Kim; Bobby Kim; Susie Y. Kim; Debra Y. Kim, all of 1450 S. Havana, Suite 312, Aurora, CO (US) 80012

( * ) Notice: Subject to any disclaimer, the term of this patent is extended or adjusted under 35 U.S.C. 154(b) by 0 days.

(21) Appl. No.: 09/576,242

(22) Filed: May 24, 2000

Related U.S. Application Data

(63) Continuation-in-part of application No. 09/190,626, filed on Nov. 12, 1998, now Pat. No. 6,138,901.

(60) Provisional application No. 60/065,824, filed on Nov. 14, 1997, provisional application No. 60/070,441, filed on Jan. 5, 1998, and provisional application No. 60/085,583, filed on May 15, 1998.

(51) Int. Cl.[7] ..... B65D 5/00; B65D 5/54

(52) U.S. Cl. ..... 229/101; 229/101.2

(58) Field of Search ..... 229/101, 101.1, 229/101.2

(56) References Cited

U.S. PATENT DOCUMENTS 2,329,797 * 9/1943 Strack ..... 229/101
2,801,506 * 10/1957 Kessler ..... 229/101
3,032,253 * 5/1962 Younger ..... 229/101
3,672,558 * 6/1972 Johnson ..... 229/101.1
3,727,827 * 4/1973 Stice ..... 229/101.1
5,495,727 * 3/1996 Strong et al. ..... 229/101

* cited by examiner

*Primary Examiner*—Allan N. Shoap
*Assistant Examiner*—Tri M. Mai
(74) *Attorney, Agent, or Firm*—Edwin H. Crabtree; Ramon L. Pizarro; Donald W. Margolis

(57) ABSTRACT

A multipurpose adjustable single sheet container for storing and shipping various sizes and shapes of items. The single sheet container is characterized by having end flaps that can be either cut or folded, at the option of the user, for enclosing the ends of the container. The container has vertical fold lines which allow the user of the container to adjust the length and the width of the container for forming different geometric shapes. The container includes a plurality of side panels. Opposite sides of the side panels are divided by vertical fold lines. Opposite ends of the side panels include upper horizontal fold lines and lower horizontal fold lines. The upper horizontal fold lines divide the side panels from a plurality of upper flaps. The lower horizontal fold lines divide the side panels from a plurality of lower flaps. Opposite sides of the upper and lower flaps are divided by vertical perforated lines. When a length of the vertical perforated lines is cut, the flaps can be folded inward when enclosing the opposite ends of the container. The upper and lower flaps also include "X" shaped diagonal fold lines. When a length of the diagonal fold lines is folded, the flaps can be folded inward providing an alternate way of enclosing the opposite ends of the container.

16 Claims, 6 Drawing Sheets

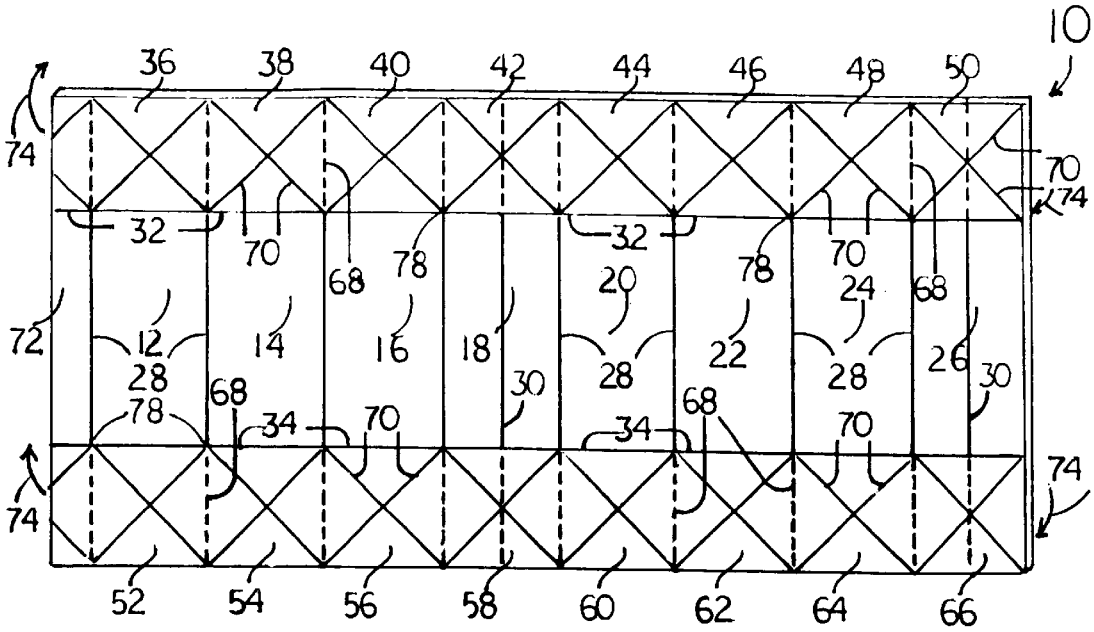
FIG. 1
FIG. 1A
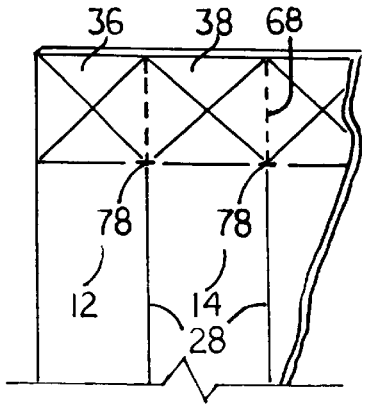

MULTIPURPOSE ADJUSTABLE SINGLE SHEET CONTAINER

This application is a continuation-in-part application of patent application Ser. No. 09/190,626, filed on Nov. 12, 1998, now U.S Pat. No. 6,138,901, which claims benefit of Ser. No. 60/065,824 filed on Nov. 14, 1997, and claims benefits of Ser. No. 60/070,441 filed on Jan. 5, 1998, and claims benefit of 60/085,583 filed May 15, 1998, by the subject inventors and having a title of "MULTIPURPOSE ADJUSTABLE SINGLE SHEET CONTAINER".

BACKGROUND OF THE INVENTION (a) Field of the Invention

This invention relates to adjustable containers and more particularly, but not by way of limitation, to a multipurpose adjustable container made of a single sheet. The single sheet having a plurality of side panels with vertical fold lines and a plurality of upper and lower end flaps which can be cut or folded for enclosing the container. The vertical fold lines allow the container to be folded into a number of different sizes and geometric shapes for storing and shipping various items.

(b) Discussion of Prior Art

In U.S. Pat. Nos. 1,125,535 to Hoffman, 3,032,253 to Younger, 3,313,467 to Anderskow et al., 3,598,303 to Folz and 3,727,827 to Stice, different types of expandable and variable sized boxes, containers and envelopes are disclosed. Also, in British Patents 371,751 to Montague et al. and 1,029,562 to Hodgkinson two different types of carton blanks are described for making various sizes of containers when folded along slots and perforated fold lines.

The above mentioned prior art patents do not specifically disclose or teach the subject invention having a plurality of side panels for adjusting the length and width of the container along with upper and lower flaps that can be either cut or folded when closing opposite ends of a container of a selected size.

SUMMARY OF THE INVENTION

In view of the foregoing, it is a primary object of the subject invention to provide a multipurpose adjustable single sheet container. Side panels of the container can be quickly folded along vertical fold lines for forming a plurality of different size containers. The container can be folded to different lengths and widths for holding various size objects.

Another object of the invention is the container includes upper flaps and lower flaps which can be cut along vertical perforated lines for folding the flaps inwardly when enclosing the opposite ends of the container.

Still another object of the invention is the upper flaps and the lower flaps also include "X" shaped diagonal fold lines. When a length of the diagonal fold lines is folded, the flaps can be folded inwardly providing an alternate way of enclosing the opposite ends of the container. The user of the subject container has an option of either cutting the perforated lines of the flaps or folding the diagonal fold lines of the flaps when enclosing the opposite ends of the container.

Yet another object of the invention is the vertical perforated lines in the flaps include a inverted "T" shaped cut therein to act as a stop. The "T" shaped cut helps prevent cutting into a vertical fold line between the panels and prior to folding the flaps inwardly when enclosing the ends of the container.

The container includes a plurality of side panels. Opposite sides of the side panels are divided by vertical fold lines.

Opposite ends of the side panels include upper horizontal fold lines and lower horizontal fold lines. The upper horizontal fold lines divide the side panels from a plurality of upper flaps. The lower horizontal fold lines divide the side panels from a plurality of lower flaps. Opposite sides of the upper and lower flaps are divided by vertical perforated lines. When a length of the vertical perforated lines is cut, the flaps can be folded inward when enclosing the opposite ends of the container. The upper and lower flaps also include "X" shaped diagonal fold lines. When a length of the diagonal fold lines is folded, the flaps can be folded inward providing an alternate way of enclosing the opposite ends of the container.

These and other objects of the present invention will become apparent to those familiar with the different types of multipurpose container boxes, container blanks and adjustable single sheet containers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 1 is a front view of the single sheet container shown having 8 side panels divided by vertical fold lines. Also, opposite ends of the side panels are shown with upper horizontal fold lines and lower horizontal fold lines. The horizontal fold lines divide the side panels from upper and lower flaps.

FIG. 1A is a front view of two of the upper flaps and positioned for cutting along a vertical perforated line between the two upper flaps.

DESCRIPTION OF THE PREFERRED EMBODIMENTS

Figure 2:
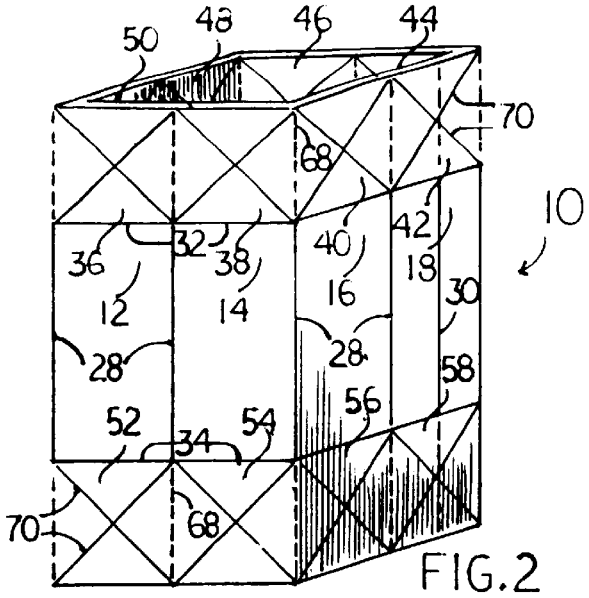
FIG. 2 is a perspective view of the container folded into a square configuration with two of the side panels on each side of the container.

In FIG. 1, a front view of the multipurpose adjustable single sheet container is shown and having general reference numeral 10. The adjustable single sheet container 10 can be made in various sizes for holding both small and large objects to be stored and/or shipped. Also, the container 10 may be made of cardboard, different grades of paper stock and like box and container materials.

Figure 3:
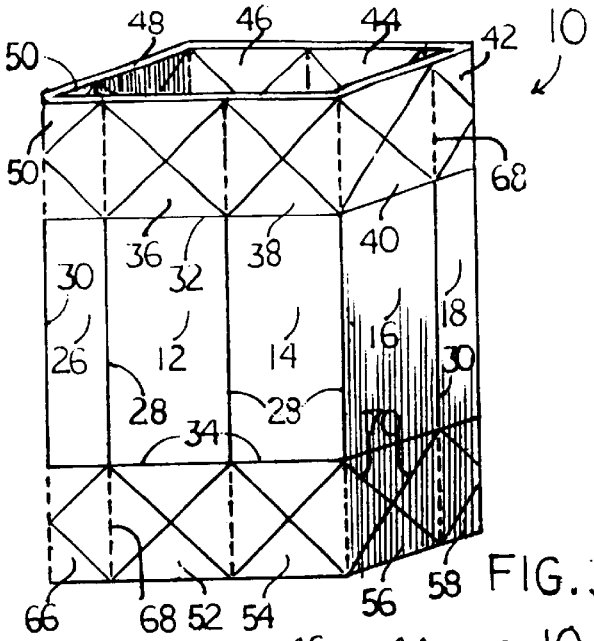
FIG. 3 is a perspective view of the container folded into a rectangular configuration with two and one half of the side panels on opposite sides of the container and one and one half of the side panels on the other two sides of the container.

The container 10, in this drawings includes a first side panel 12, a second side panel 14, a third side panel 16, a fourth side panel 18, a fifth side panel 20, a sixth side panel 22, a seventh side panel 24 and an eighth side panel 26. The sides panels are of equal size, parallel to each other and divided by a plurality of vertical fold lines 28. Also, fourth and eighth side panels 18 and 26 include an added fold line 30 for dividing in two the height of these panels. Further, the second and sixth side panels 14 and 22, while not shown in the drawings, can include the added fold lines 30. This feature provides for additional folding options as shown in FIG. 3. Each of the side panels include a height "H" and a width "W".

An upper end of each side panel includes an upper horizontal fold line 32. A lower end of each side panel includes lower a lower horizontal fold line 34. The upper horizontal fold line 32 divides the upper portion of the side panels 12, 14, 18, 20, 22, 24 and 28 from a first upper flap 36, a second upper flap 38, a third upper flap 40, a fourth upper flap 42, a fifth upper flap 44, a sixth upper flap, a seventh upper flap 48 and an eighth upper flap 50. The upper flaps are of equal size and parallel to each other.

The lower horizontal fold line 34 divides a lower portion of the side panels 12, 14, 16, 18, 20, 22, 24 and 26 from a first lower flap 52, a second lower flap 54, a third lower flap 56, a fourth lower flap 58, a fifth lower flap 60, a sixth lower flap 62, a seventh lower flap 64 and an eighth lower flap 66. The lower flaps are of equal size and parallel to each other.

The upper and lower flaps are divided from each other by vertical perforation lines 68. The perforation lines 68 are used when cutting and folding the flaps when enclosing opposite ends of the container 10. Also, additional perforation lines 68 are used inconjunction with the additional fold lines 30 when the fold lines 30 are used for forming different container shapes. Also, the upper and lower flaps include "X" shaped diagonal fold lines 70 which are used for folding a portion of each of the flaps. The first side panel 12 is divided by one of the vertical fold lines 28 from a glue panel 72. When the glue panel 72 is folded, it is attached to a portion of a back side of the eighth side panel 26 as indicated by arrows 74.

It should be noted that while the drawings disclose the use of eight side panels with upper and lower flaps, the adjustable single sheet container 10 can have four side panels with upper and lower flaps for forming a square shaped container, the single sheet container 10 can also have six side panels and more for forming different rectangular shaped containers. Further, the side panels can include additional added vertical lines 30 and perforated lines 68 for providing even more options for the user to fold the container 10 into various configurations for storing and shipping different size items.

In FIG. 1A, a front view of a portion of the upper flaps 36 and 38 are shown. In this drawing, various types of cutting tools or the hand can be used to cut the vertical perforated lines 68 between the two upper flaps. Also the perforated lines can be torn by hand or cut with other types of cutting tools. At the bottom of the perforated line 68 is an inverted "T" shaped cut 78, which acts a stop to help prevent the knife 76 from cutting into the vertical fold line 28.

In FIG. 2, a perspective view of the container 10 is shown folded into a square configuration. In this example, one side of the container includes the first and second side panels 12 and 14 with the opposite side of the container including fifth and sixth side panels 20 and 22. Fourth and fifth side panels 16 and 18 are disposed opposite the seventh and eighth side panels 24 and 26. It should be noted that the container 10 now has a length of twice the width "w" of each panel or a total of "2w". The container 10 also has a width of twice the width "w" of each panel or a total of "2w". The height "H" shown in FIG. 1 remains constant. Obviously by adjusting the length and width of the container 10 as shown in the drawings, various sizes and shapes of objects can be placed therein for storage or shipping.

Figure 2A:
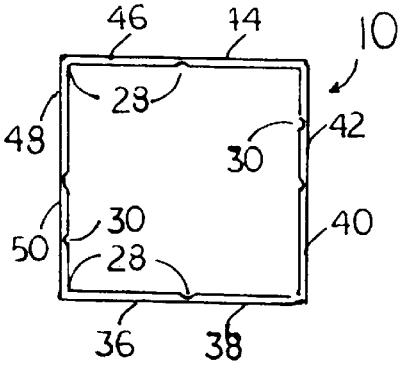
FIG. 2A is a top view of the container shown in FIG. 2 showing the 8 side panels formed into the square configuration.

In FIG. 2A, a top view of the container 10 is shown. In this view, the length and width of the container can be seen and formed into the square shape configuration.

Figure 2B:
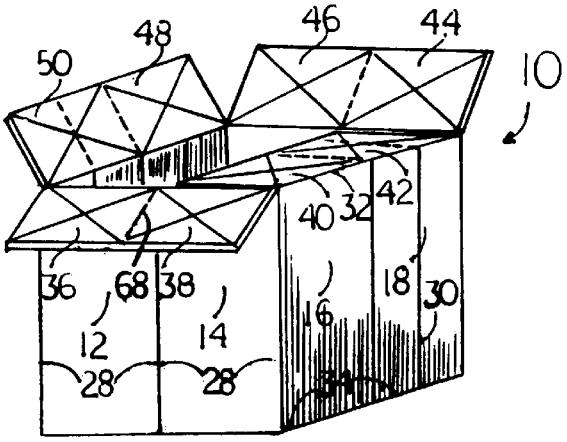
FIG. 2B is a perspective view of the vertical perforated lines between the upper flaps having been cut and positioned for folding inwardly for enclosing the upper end of the container. The bottom end of the container is shown already having been enclosed using cut lower flaps.

In FIG. 2B, a perspective view of the container 10 is shown. In this drawing, four of the vertical perforated lines 68 have been cut so that the upper flaps can be folded for enclosing the top of the container. In this example, the perforated line 68 between the second and third upper flaps 38 and 40 has been cut and the perforated line 68 between the fourth and fifth upper flaps 42 and 44 has been cut. The fourth and fifth upper flaps 42 and 44 are shown folded inwardly to cover a portion of the top of the container 10. Likewise, the perforated line 68 between the sixth and seventh upper flaps 46 and 48 has been cut and the perforated line been the eighth and first flaps 50 and 36 has been cut. The bottom end of the container 10 is shown already having been enclosed by cutting selected vertical perforated lines 68 and folding the lower flaps inwardly.

Figure 2C:
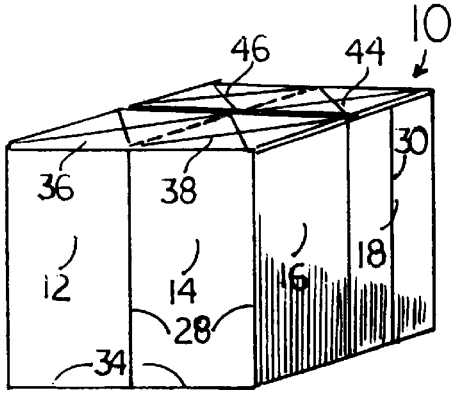
FIG. 2C is another perspective view of the container shown in FIG. 2B with the upper flaps folded on top of the upper end of the container for enclosing the container.

In FIG. 2C, another perspective view of the container 10 is shown and similar to FIG. 2B. In this drawing, the seventh and eighth upper flaps 48 and 50 have been folded inwardly. The first and second upper flaps 36 and 38 and the fifth and sixth upper flaps 44 and 46 are then folded on top of the other upper flaps completing the enclosing of the top of the container 10.

Figure 2D:
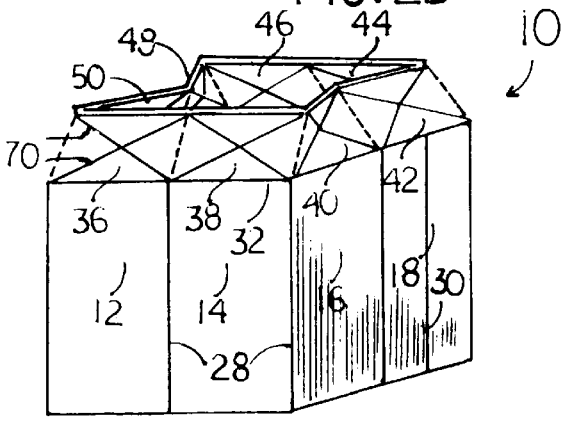
FIG. 2D is a perspective view of "X" shaped diagonal lines in the upper flaps used for folding a portion of the flaps. The folded flaps are shown ready for folding inwardly and enclosing the upper end of the container. The bottom end of the container is shown already having been enclosed using folded lower flaps.

In FIG. 2D, another perspective view of the container 10 is shown wherein the "X" shaped diagonal lines 70 are used for folding the upper and lower flaps rather than cutting along the vertical perforated lines 68. In this example, the third and fourth upper flaps 40 and 42 have been folded inwardly with folding occurring along one of the "X" shaped diagonal lines 70 on these flaps. Likewise, the seventh and eighth upper flaps 48 and 50 are positioned for folding inwardly with the folding occurring along one of the "X" shaped diagonal lines 70 on the these flaps. The bottom end of the container 10 is shown already having been enclosed using folded lower flaps.

Figure 2E:
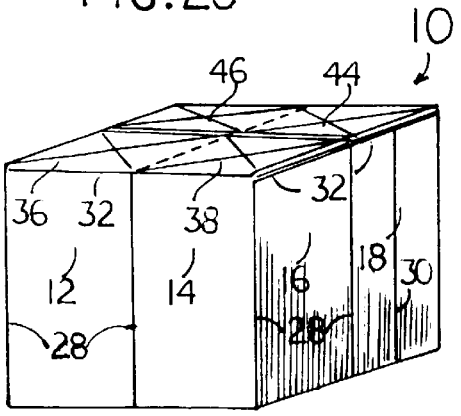
FIG. 2E is another perspective view of the container shown in FIG. 2D with the upper flaps folded on top of the upper end of the container for enclosing the container.

In FIG. 2E, another perspective view of the container 10 is shown similar to FIG. 2D. In this drawing, the seventh and eighth upper flaps 48 and 50 have been folded inwardly using the diagonal fold lines. The first and second upper flaps 36 and 38 and the fifth and sixth upper flaps 44 and 46 are then folded on top of the other upper flaps completing the enclosing of the top of the container 10.

In FIG. 3, a perspective view of the container 10 is shown folded into a rectangular configuration. In this example, one side of the container includes the first and second side panels 12 and 14 and one half of eighth panel 26 with the opposite side of the container including the fifth and sixth side panels 20 and 22 and one half of the fourth side panel 18. The other sides of the container include the third panel 16 and one half of the fourth side panel 18 and the seventh side panel 24 and one half of the eighth side panel 26. It should be noted that the container 10 now has a length of two and one half of the width "w" of each panel or a total of "2½". The container 10 also has a width of one and one half the width "w" of each panel or a total of "1½". As mentioned above, the height "H" shown in FIG. 1 remains constant.

Figure 3A:
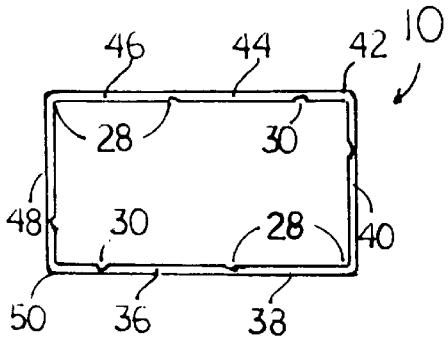
FIG. 3A is a top view of the container shown in FIG. 3 showing the 8 side panels formed into the rectangular shape.

In FIG. 3A, a top view of the container 10 as seen in FIG. 2 is shown. In this view, the length and width of the container can be seen and formed into the rectangular shaped configuration.

Figure 3B:
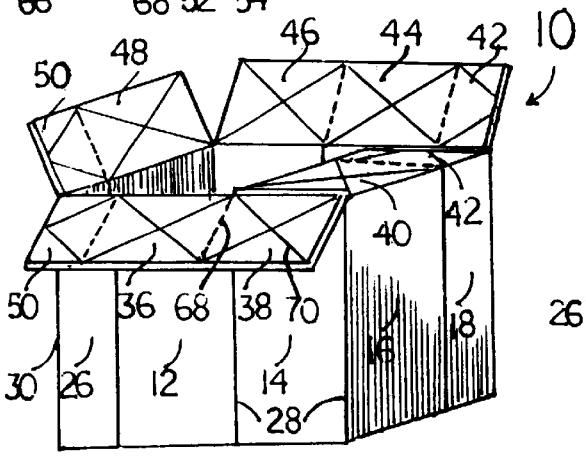
FIG. 3B is a perspective view of the vertical perforated lines between the upper flaps having been cut and positioned for folding inwardly for enclosing the upper end of the container. The bottom end of the container is shown already having been enclosed using cut lower flaps.

In FIG. 3B, a perspective view of the container 10 is shown. In this drawing, four of the vertical perforated lines 68 have been cut so that the upper flap can be folded for enclosing the top of the container. In this example, the perforated line 68 between the second and third upper flaps 38 and 40 has been cut and the perforated line 68 dividing the fourth flap 42 in two has been cut. The third upper flaps 40 and one half of the fourth upper flap 42 are shown folded inwardly to cover a portion of the top of the container 10. Likewise, the perforated line 68 between the sixth and seventh upper flaps 46 and 48 has been cut and the perforated line dividing the eighth flap 50 in two has been cut. The bottom end of the container 10 is shown already having been enclosed by cutting selected vertical perforated lines 68 and folding the lower flaps inwardly.

Figure 3C:
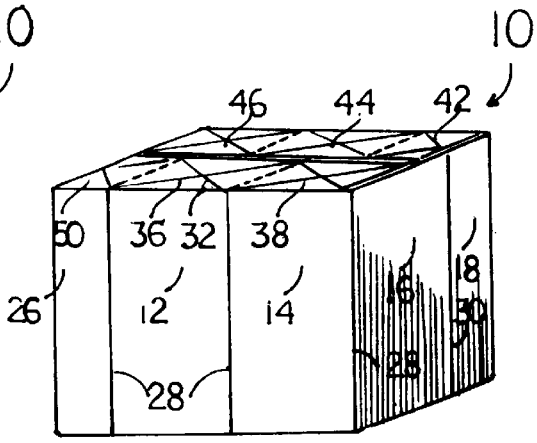
FIG. 3C is another perspective view of the container shown in FIG. 3B with the upper flaps folded on top of the upper end of the container for enclosing the container.

In FIG. 3C, another perspective view of the container 10 is shown and similar to FIG. 3B. In this drawing, the seventh upper flap 48 and one half of the eighth upper flap 50 have been folded inwardly. The first and second upper flaps 36 and 38 and one half of the eighth upper flap 50 and the fifth and sixth upper flaps 44 and 46 and one half of the fourth upper flap 42 are then folded on top of the other upper flaps completing the enclosing of the top of the container 10. Since the vertical perforated lines 68 have been used in the divided fourth and eighth upper flaps 42 and 50 and the divided fourth and eighth lower flaps 58 and 66, the "X" shaped diagonal fold lines 70 are not used for enclosing the container 10.

Figure 4:
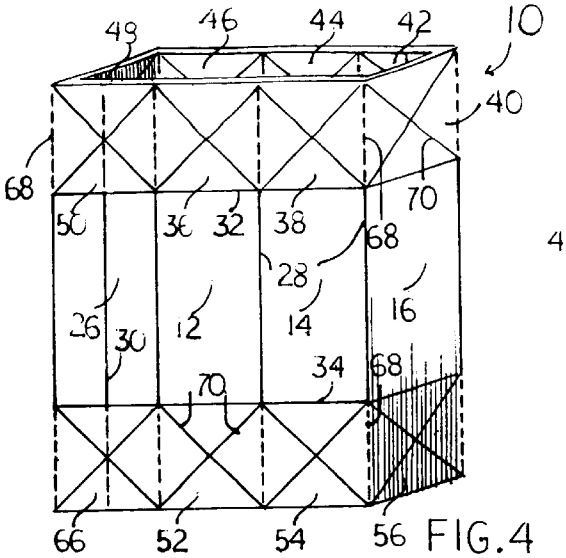
FIG. 4 is a perspective view of the container folded into another rectangular configuration with three of the side panels on opposite sides of the container and one side panel on the other two sides of the container.

In FIG. 4, a perspective view of the container 10 is shown folded into another rectangular configuration. In this example, one side of the container includes the first and second side panels 12 and 14 and the eighth side panel 26 with the opposite side of the container including fourth, fifth and sixth side panels 18, 20 and 22. The third side panel 16 is disposed opposite the seventh side panel 24. It should be noted that the container 10 now has a length of three times the width "w" of each panel or a total of "3w". The container 10 now has a width "w".

Figure 4A:
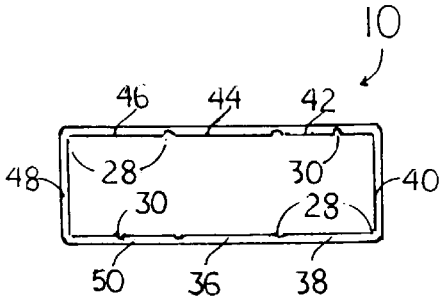
FIG. 4A is a top view of the container shown in FIG. 4 showing the 8 side panels formed into the rectangular configuration.

In FIG. 4A, a top view of the container 10 as seen in FIG. 4 is shown. In this view, the length and width of the container can be seen and formed into the rectangular shaped configuration.

Figure 4B:
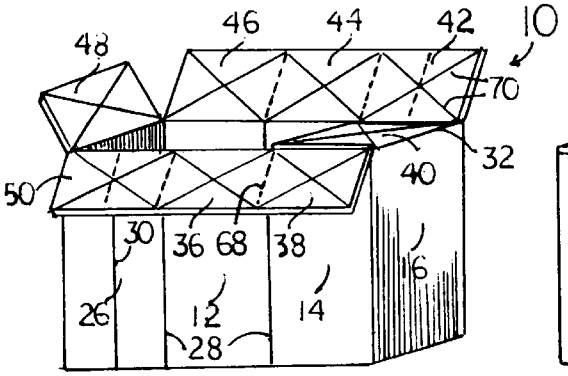
FIG. 4B is a perspective view of the vertical perforated lines between the upper flaps having been cut and positioned for folding inwardly for enclosing the upper end of the container. The bottom end of the container is shown already having been enclosed using cut lower flaps.

In FIG. 4B, a perspective view of the container 10 is shown. In this drawing, four of the vertical perforated lines 68 have been cut so that the upper flaps can be folded for enclosing the top of the container. In this example, the perforated line 68 between the second and third upper flaps 38 and 40 has been cut and the perforated line 68 between the third and fourth upper flaps 40 and 42 has been cut. The third upper flap 40 is shown folded inwardly to cover a portion of the top of the container 10. Likewise, the perforated line 68 between the sixth and seventh upper flaps 46 and 48 has been cut and the perforated line between the seventh and eighth upper flaps 48 and 50 has been cut. The bottom end of the container 10 is shown already having been enclosed by cutting selected vertical perforated lines 68 and folding the lower flaps inwardly.

Figure 4C:
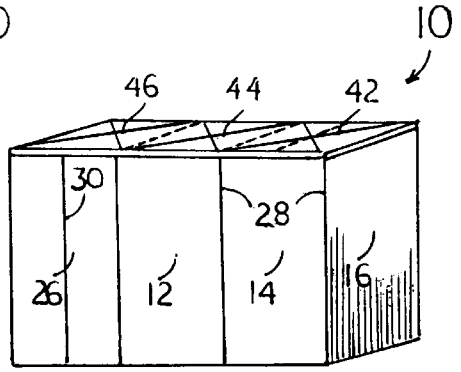
FIG. 4C is anther perspective view of the container shown in FIG. 4B with the upper flaps folded on top of the upper end of the container for enclosing the container.

In FIG. 4C, another perspective view of the container 10 is shown and similar to FIG. 4B. In this drawing, the seventh upper flap has been folded inwardly. The first, second and eighth upper flaps 36, 38 and 50 and the fourth, fifth and sixth upper flaps 42, 44 and 46 are then folded on top of the other upper flaps completing the enclosing of the top of the container 10.

Figure 4D:
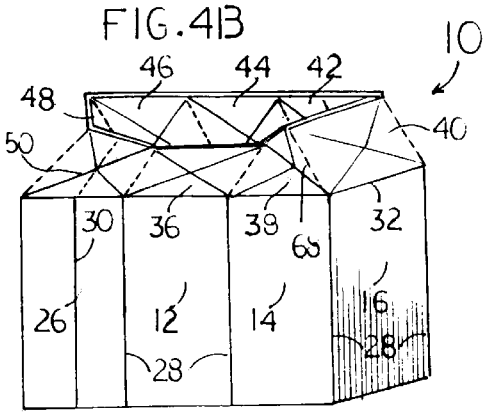
FIG. 4D is a perspective view of "X" shaped diagonal lines in the upper flaps used for folding a portion of the flaps. The folded flaps are shown ready for folding inwardly and enclosing the upper end of the container. The bottom end of the container is shown already having been enclosed using folded lower flaps.

In FIG. 4D, another perspective view of the container 10 is shown wherein the "X" shaped diagonal lines 70 are used for folding the upper and lower flaps rather than cutting along the vertical perforated lines 68. In this example, the third upper flap 40 has been folded inwardly with folding occurring along one of the "X" shaped diagonal lines 70 on the second and the fourth upper flaps 38 and 44. Likewise, the seventh upper flap 48 is positioned for folding inwardly with the folding occurring along one of the "X" shaped diagonal lines 70 on the sixth and the eighth upper flaps 46 and 50. The bottom end of the container 10 is shown already having been enclosed using folded lower flaps.

Figure 4E:
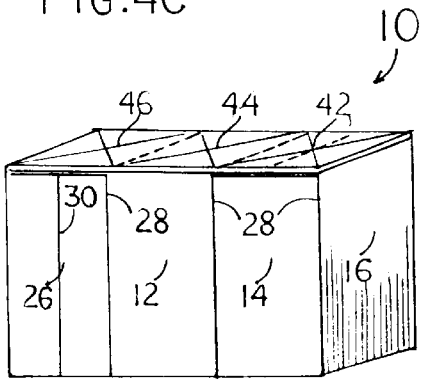
FIG. 4E is anther perspective view of the container shown in FIG. 4D with the upper flaps folded on top of the upper end of the container for enclosing the container.

In FIG. 4E, another perspective view of the container 10 is shown similar to FIG. 4D. In this drawing, the seventh upper flap 48 has been folded inwardly using the diagonal fold lines on the sixth and eighth upper flaps 46 and 50. The first, second and eighth upper flaps 36, 38 50 and the fourth, fifth and sixth upper flaps 42, 44 and 46 are then folded on top of the other upper flaps completing the enclosing of the top of the container 10.

Figure 5:
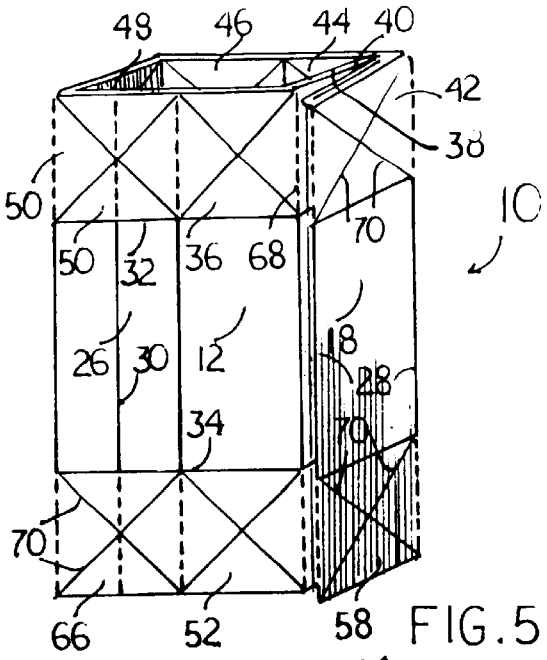
FIG. 5 is a perspective view of the container folded into another but smaller rectangular configuration with two of the side panels on each side of the container and with two of the side panels folded next to each other.

In FIG. 5, a perspective view of the container 10 is shown folded into a smaller rectangular configuration. In this example, one side of the container includes the first and eighth side panels 12 and 26 with the opposite side of the container including the fifth and sixth side panels 20 and 22. The fourth side panel 18, in this example, is folded next to third side panel 16 and placed next to the second panel 14 for decreasing the length and width of the container 10. It should be noted that the container 10 now has a length of twice the width "w" of each panel or a total of "2w". The container 10 now has a width "w".

Figure 5A:
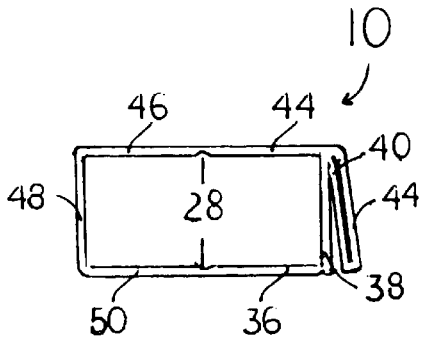
FIG. 5A is a top view of the container shown in FIG. 5 showing 6 side panels formed into the rectangular shaped configuration.

In FIG. 5A, a top view of the container 10 is shown. In this view, the length and width of the container can be seen and formed into the smaller rectangular shaped configuration.

Figure 5B:
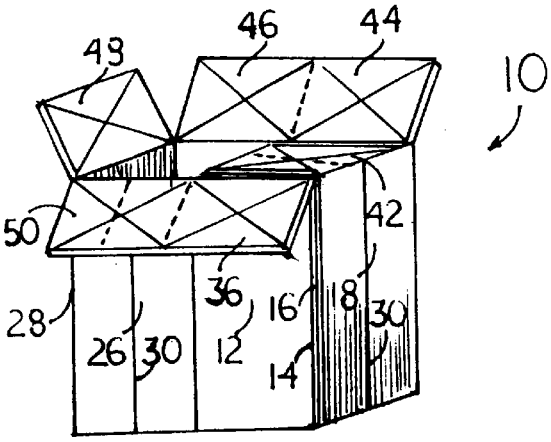
FIG. 5B is a perspective view of the vertical perforated lines between the upper flaps having been cut and positioned for folding inwardly for enclosing the upper end of the container. The bottom end of the container is shown already having been enclosed using cut lower flaps.

In FIG. 5B, a perspective view of the container 10 is shown. In this drawing, four of the vertical perforated lines 68 have been cut so that the upper flaps can be folded for enclosing the top of the container. In this example, the perforated line 68 between the first and second upper flaps 36 and 38 has been cut, the perforated line 68 between the second and third upper flaps 38 and 40 has been cut and the fourth and fifth upper flaps 42 and 44 and 42 has been cut. The second, third and fourth upper flaps 38, 40 and 42 are shown folded together and inwardly to cover a portion of the top of the container 10. Likewise, the perforated line 68 between the sixth and seventh upper flaps 46 and 48 has been cut and the perforated line between the seventh and eighth upper flaps 48 and 50 has been cut. The bottom end of the container 10 is shown already having been enclosed by cutting selected vertical perforated lines 68 and folding the lower flaps inwardly.

Figure 5C:
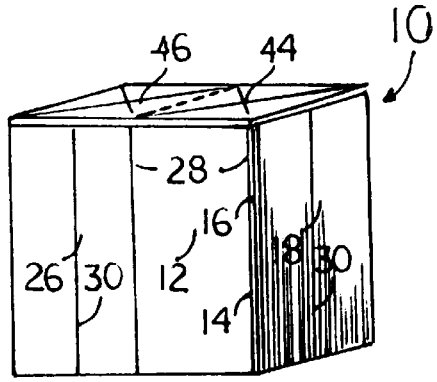
FIG. 5C is anther perspective view of the container shown in FIG. 5B with the upper flaps folded on top of the upper end of the container for enclosing the container.

In FIG. 5C, another perspective view of the container 10 is shown and similar to FIG. 5B. In this drawing, the seventh upper flap 48 has been folded inwardly. The first and eighth upper flaps 36 and 50 and the fifth and sixth upper flaps 44 and 46 are then folded on top of the other upper flaps completing the enclosing of the top of the container 10.

Figure 5D:
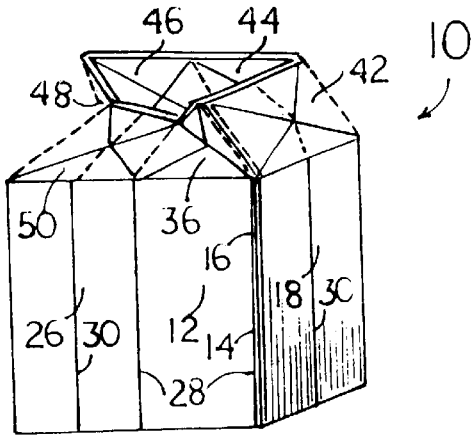
FIG. 5D is a perspective view of "X" shaped diagonal lines in the upper flaps used for folding a portion of the flaps. The folded flaps are shown ready for folding inwardly and enclosing the upper end of the container. The bottom end of the container is shown already having been enclosed using folded lower flaps.

In FIG. 5D, another perspective view of the container 10 is shown wherein the "X" shaped diagonal lines 70 are used for folding the upper and lower flaps rather than cutting along the vertical perforated lines 68. In this example, the second, third and fourth upper flaps 38, 40 and 42 have been folded inwardly with folding occurring along one of the "X" shaped diagonal lines 70 on the first and the fifth upper flaps 36 and 44. Likewise, the seventh upper flap 48 is positioned for folding inwardly with the folding occurring along one of the "X" shaped diagonal lines 70 on the sixth and the eighth upper flaps 46 and 50. The bottom end of the container 10 is shown already having been enclosed using folded lower flaps.

Figure 5E:
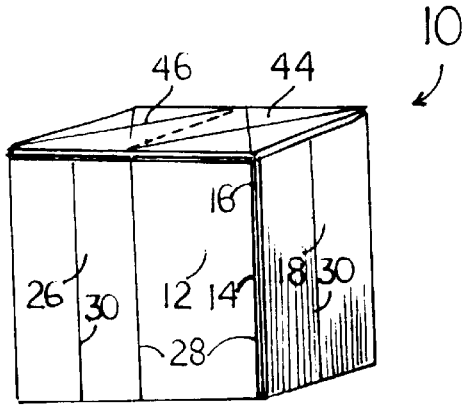
FIG. 5E is another perspective view of the container shown in FIG. 5D with the upper flaps folded on top of the upper end of the container for enclosing the container.

In FIG. 5E, another perspective view of the container 10 is shown similar to FIG. 5D. In this drawing, the seventh upper flap 48 has been folded inwardly using the diagonal fold lines on the sixth and eighth upper flaps 46 and 50. The first and eighth upper flaps 36 and 50 and the fifth and sixth upper flaps 44 and 46 are then folded on top of the other upper flaps completing the enclosing of the top of the container 10.

Figure 6:
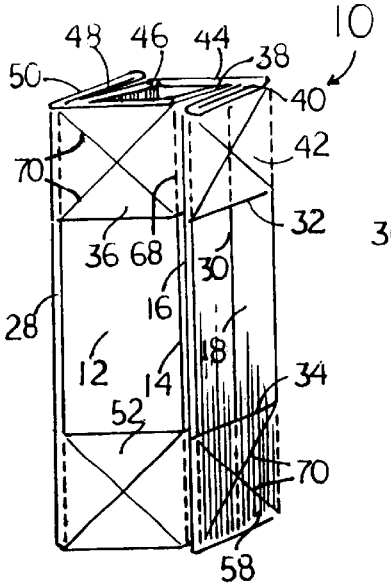
FIG. 6 is a perspective view of the container folded into a smaller square configuration and with two pair of the side panels folded next to each other.

In FIG. 6, a perspective view of the container 10 is shown folded into a smaller square configuration. In this example, one side of the container includes the first panel 12 with the opposite side of the container including the fifth panel 20. The fourth side panel 18, in this example, is folded next to third side panel 16 and placed against the side of the second panel 14. Also, the eighth panel 26 is folded next to the seventh panel 24 and placed against the sixth panel 22. This feature of folding panels against each other as shown provides for further decreasing the length and width of the container 10. It should be noted that the container 10 now has a length of "w" and a width of "w".

Figure 6B:
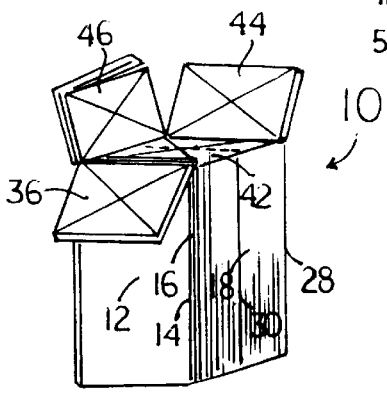
FIG. 6B is a perspective view of the vertical perforated lines between the upper flaps having been cut and positioned for folding inwardly for enclosing the upper end of the container. The bottom end of the container is shown already having been enclosed using cut lower flaps.
Figure 6A:
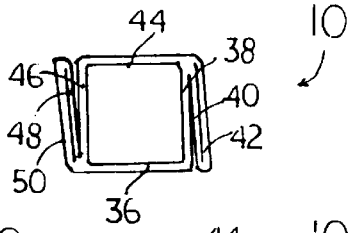
FIG. 6A is a top view of the container shown in FIG. 6 showing 4 side panels formed into a square configuration.

In FIG. 6A, a top view of the container 10 is shown. In this view, the length and width of the container can be seen and formed into the smaller square shaped configuration.

In FIG. 6B, a perspective view of the container 10 is shown. In this drawing, four of the vertical perforated lines 68 have been cut so that the upper flaps can be folded for enclosing the top of the container. In this example, the perforated line 68 between the first and second upper flaps 36 and 38 has been cut, the perforated line 68 between the second and third upper flaps 38 and 40 has been cut and between the fourth and fifth upper flaps 42 and 44 and 42 has been cut. The second, third and fourth upper flaps 38, 40 and 42 are shown folded together and inwardly to cover a portion of the top of the container 10. Likewise, the perforated line 68 between the fifth and sixth upper flaps 44 and 46 has been cut, the perforated line between the sixth and seventh upper flaps 46 and 48 has been cut and the perforated line 68 between the eighth and the first upper flaps 50 and 36 has been cut. The bottom end of the container 10 is shown already having been enclosed by cutting selected vertical perforated lines 68 and folding the lower flaps inwardly.

Figure 6C:
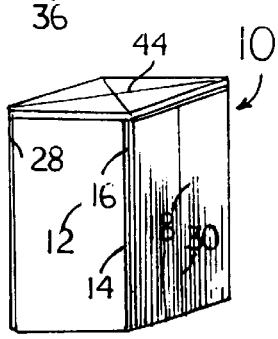
FIG. 6C is anther perspective view of the container shown in FIG. 6B with the upper flaps folded on top of the upper end of the container for enclosing the container.

In FIG. 6C, another perspective view of the container 10 is shown and similar to FIG. 6B. In this drawing, the sixth, seventh and eighth upper flaps 46, 48 and 50 has been folded inwardly. The first and the fifth upper flaps 36 and 44 are then folded on top of the other upper flaps completing the enclosing of the top of the container 10.

While, the folding of the various side panels and the cutting and folding of the upper and lower flaps are shown in the drawings for enclosing the container 10, it can be appreciated by those skilled in the art that there are any number of additional geometric configurations that can formed using the various vertical fold lines, the horizontal fold lines, the vertical perforated lines and the "X" shaped diagonal fold lines without departing from the spirit and scope of the invention.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A multipurpose adjustable single sheet container for folding into various square and rectangular shapes, the container used storing and shipping various sizes and shapes of items, the single sheet container comprising:

a plurality of parallel side panels having equal size, opposite sides of said side panels divided by vertical fold lines, upper ends of said side panels having upper horizontal fold lines, lower ends of said side panels having lower horizontal fold lines;

a plurality of upper flaps having equal size, said upper flaps divided from said side panels by the upper horizontal fold lines, opposite sides of said upper flaps divided by vertical perforated lines, said upper flaps including "X" shaped diagonal fold lines; and a plurality of lower flaps having equal size, said lower flaps divided from said side panels by the lower horizontal fold lines, said, opposite sides of said lower flaps divided by vertical perforated lines, said lower flaps including "X" shaped diagonal fold lines;

whereby, when a length of the vertical perforated lines is cut on said upper and lower flaps, said upper and lower flaps can be folded inwardly when enclosing the opposite ends of the container, whereby when a length of the diagonal fold lines is folded on said upper and lower flaps, said upper and lower flaps can be folded inward providing an alternate way of enclosing the opposite ends of the container.

2. The sheet container as described in claim 1 further including added vertical fold lines dividing two of said side panels, said added vertical fold lines providing for additional folding options when folding the container into various square and rectangular shapes.

3. The sheet container as described in claim 1 further including means for securing one side of one of said panels to a side of another panel.

4. The sheet container as described in claim 3 wherein said means for securing is a glue panel attached to one side of one of said panels, said glue panel secured to a back side of another panel.

5. A multipurpose adjustable single sheet container for folding into various square and rectangular shapes, the container used storing and shipping various sizes and shapes of items, the single sheet container comprising:

a plurality of parallel side panels having equal size, said side panels include a first side panel, a second side panel, a third side panel and a fourth side panel, opposite sides of said side panels divided by vertical fold lines, upper ends of said side panels having upper horizontal fold lines, lower ends of said side panels having lower horizontal fold lines;

a plurality of upper flaps having equal size; said upper flaps including a first upper flap, a second upper flap, a third upper flap and a fourth upper flap, said upper flaps divided from said side panels by the upper horizontal fold lines, opposite sides of said upper flaps divided by vertical perforated lines, said upper flaps including "X" shaped diagonal fold lines; and a plurality of lower flaps having equal size, said lower flaps including a first lower flap, a second lower flap, a third lower flap and a fourth lower flap, said lower flaps divided from said side panels by the lower horizontal fold lines, said, opposite sides of said lower flaps divided by vertical perforated lines, said lower flaps including "X" shaped diagonal fold lines;

whereby, when a length of the vertical perforated lines is cut on said upper and lower flaps, said upper and lower flaps can be folded inwardly when enclosing the opposite ends of the container, whereby when a length of the diagonal fold lines is folded on said upper and lower flaps, said upper and lower flaps can be folded inward providing an alternate way of enclosing the opposite ends of the container.

6. The sheet container as described in claim 5 further including added vertical fold lines dividing said first and third side panels, said added vertical fold lines providing for additional folding options when folding the container into various square and rectangular shapes.

7. The sheet container as described in claim 6 further including added vertical perforated lines dividing said first and third upper flaps and said first and third lower flaps, said added perforated lines providing for additional folding options when folding the container into various square and rectangular shapes.

8. The sheet container as described in claim 5 further including added vertical fold lines dividing the second and fourth side panels, said added vertical fold lines providing for additional folding options when folding the container into various square and rectangular shapes.

9. The sheet container as described in claim 8 further including added vertical perforated lines dividing said second and fourth upper flaps and said second and fourth lower flaps, said added perforated lines providing for additional folding options when folding the container into various square and rectangular shapes.

10. The sheet container as described in claim 6 further including a glue panel attached to one side of said first panel, said glue panel secured to a back side of said fourth panel.

11. A multipurpose adjustable single sheet container for folding into various square and rectangular shapes, the container used storing and shipping various sizes and shapes of items, the single sheet container comprising:

a plurality of parallel side panels having equal size, said side panels include a first side panel, a second side panel, a third side panel, a fourth side panel, a fifth panel, a sixth panel, a seventh panel and an eighth panel, opposite sides of said side panels divided by vertical fold lines, upper ends of said side panels having upper horizontal fold lines, lower ends of said side panels having lower horizontal fold lines;

a plurality of upper flaps having equal size, said upper flaps including a first upper flap, a second upper flap, a third upper flap, a fourth upper flap, a fifth upper flap, a sixth upper flap, a seventh upper flap and an eighth upper flap, said upper flaps divided from said side panels by the upper horizontal fold lines, opposite sides of said upper flaps divided by vertical perforated lines, said upper flaps including "X" shaped diagonal fold lines; and a plurality of lower flaps having equal size, said lower flaps including a first lower flap, a second lower flap, a third lower flap, a fourth lower flap, a fifth lower flap, a sixth lower flap, a seventh lower flap and an eighth lower flap, said lower flaps divided from said side panels by the lower horizontal fold lines, said, opposite sides of said lower flaps divided by vertical perforated lines, said lower flaps including "X" shaped diagonal fold lines;

whereby, when a length of the vertical perforated lines is cut on said upper and lower flaps, said upper and lower flaps can be folded inwardly when enclosing the opposite ends of the container, whereby when a length of the diagonal fold lines is folded on said upper and lower flaps, said upper and lower flaps can be folded inward providing an alternate way of enclosing the opposite ends of the container.

12. The sheet container as described in claim 11 further including added vertical fold lines dividing said fourth and eighth side panels, said added vertical fold lines providing for additional folding options when folding the container into various square and rectangular shapes.

13. The sheet container as described in claim 12 further including added vertical perforated lines dividing said fourth and eighth upper flaps and said fourth and eighth lower flaps, said added perforated lines providing for additional folding options when folding the container into various square and rectangular shapes.

14. The sheet container as described in claim 13 further including added vertical fold lines dividing the second and sixth side panels, said added vertical fold lines providing for additional folding options when folding the container into various square and rectangular shapes.

15. The sheet container as described in claim 14 further including added vertical perforated lines dividing said second and sixth upper flaps and said second and sixth lower flaps, said added perforated lines providing for additional folding options when folding the container into various square and rectangular shapes.

16. The sheet container as described in claim 11 further including a glue panel attached to one side of said first panel, said glue panel secured to a back side of said eighth panel.

* * * * *